US005370073A

United States Patent [19]

Hayashi

[11] Patent Number: 5,370,073

[45] Date of Patent: Dec. 6, 1994

[54] THREAD CUTTING DEVICE FOR A SEWING MACHINE

[75] Inventor: Kazutoshi Hayashi, Nagoya, Japan

[73] Assignee: Brother Kogyo Kabushiki Kaisha, Nagoya, Japan

[21] Appl. No.: 87,278

[22] Filed: Jul. 8, 1993

[30] Foreign Application Priority Data

Jul. 27, 1992 [JP] Japan ..... 4-058319[U]

[51] Int. Cl.[5] ..... D05B 65/00

[52] U.S. Cl. ..... 112/291

[58] Field of Search ..... 112/291, 293, 296, 285; 83/910, 950, 902

[56] References Cited

U.S. PATENT DOCUMENTS 4,365,568 12/1982 Ross ..... 112/291
4,592,297 6/1986 Asano et al. ..... 112/291 X
5,027,731 7/1991 Sato et al. ..... 112/291 X

FOREIGN PATENT DOCUMENTS 2-148675 12/1990 Japan .
5-49778 3/1993 Japan .

*Primary Examiner*—Clifford D. Crowder
*Assistant Examiner*—Paul C. Lewis
*Attorney, Agent, or Firm*—Oliff & Berridge

[57] ABSTRACT

A movable blade unit in an automatic thread cutting device comprises a plate-like arresting member having an arresting portion for arresting the needle thread and the bobbin thread. A plate-like movable blade provided with a cutting edge cuts the needle thread and the bobbin thread in cooperation with a fixed blade and is disposed under the arresting member. A plate-like guide member is disposed under the movable blade and provided with a guide portion for guiding the needle thread and the bobbin thread arrested by the arresting member into a slit formed in the arresting member. A spacer interposed between the movable blade and the guide member forms a gap for receiving the fixed blade between the movable blade and the guide member. These members of the movable blade unit are easy to form; hence, the movable blade unit can be fabricated at a reduced cost and surely holds and cuts the needle thread and the bobbin thread.

22 Claims, 9 Drawing Sheets

THREAD CUTTING DEVICE FOR A SEWING MACHINE

BACKGROUND OF THE INVENTION

1. Field of the Invention

The present invention relates to a thread cutting device for a sewing machine. More particularly, the invention relates to an automatic thread cutting device for a sewing machine incorporating an improved movable blade unit capable of catching both the needle thread and the bobbin thread when cutting the threads and capable of cutting the threads in cooperation with a fixed blade.

2. Description of the Related Art

A known automatic thread cutting device for a sewing machine is disposed between the throat plate and the loop catcher and is driven for timed action by the rotating hook shaft to cut both the needle thread and the bobbin thread automatically.

A thread cutting device proposed in Japanese Utility Model Laid-open (Kokai) No. Hei 2-148675 is provided with a movable blade unit comprising an upper and a lower plate, and an arresting plate formed of a synthetic resin connected to the tips of the upper and lower plates. The arresting plate has an arresting portion for arresting the needle thread and the bobbin thread. The upper plate is provided with a movable blade, and the lower plate has a thread drawing portion for drawing the threads during cutting. The movable blade unit is reciprocated by a driving mechanism at the end of the sewing operation to arrest the needle thread and the bobbin thread. Then, as the needle thread and the bobbin thread are drawn by the thread drawing portion, the needle thread and the bobbin thread are sheared off between the movable blade and a fixed blade.

This known thread cutting device with a movable blade unit comprising upper and lower plates and an arresting member is unable to cut the threads if the shape of the junction of the arresting member and the upper and lower plates is not smooth. When the junction is rough, the threads are caught by the junction when the movable blade unit is reciprocated.

To solve this problem, the inventors of the thread cutting device disclosed in Japanese Utility Model Laid-open (Kokai) No. Hei 2-148675 formed the movable blade unit only by upper and lower plates as disclosed in Japanese Patent Laid-open No. 5-49778. An arresting portion is formed in the lower plate, and a guide portion is formed in the free end of the lower plate to prevent the threads from entering the space between the upper and lower plates. The guide portion is formed by bending up the free end of the lower plate so that the extremity of the free end protrudes slightly from the upper plate. Such improvements prevent the movable blade unit from catching the needle thread and the bobbin thread when cutting the threads and enhance the reliability of the thread cutting device.

However, since the lower plate of the movable blade unit has the guide portion formed by bending its free end upward in addition to the thread drawing portion and the arresting portion, the lower plate has a complex shape. Thus, the lower plate requires plural processes to form the plate, which increases the cost of the movable blade unit.

SUMMARY OF THE INVENTION

The present invention solves such problems in the prior art. It is therefore an object of the present invention to provide an automatic thread cutting device for a sewing machine having a simple construction, surely arresting and cutting the needle thread and the bobbin thread, and providing an inexpensive movable blade unit.

To achieve the above and other objects, the present invention provides an automatic thread cutting device for a sewing machine disposed within the bed of the sewing machine to cut the needle thread and the bobbin thread simultaneously upon the termination of the sewing operation of the sewing machine. The device comprises a fixed blade fixed to the frame of the bed of the sewing machine. A movable blade unit capable of arresting the needle thread and the bobbin thread and capable of cutting the needle thread and the bobbin thread cooperates with the fixed blade. A driving means reciprocates the movable blade unit. A guide member disposed near the movable blade unit to guide the needle thread and the bobbin thread toward the movable blade unit enables the movable blade unit to arrest the needle thread and the bobbin thread.

The movable blade unit comprises an arresting member for arresting the needle thread and the bobbin thread when the movable blade unit is reciprocated by the driving means. A movable blade disposed near the lower surface of the arresting member cuts the needle thread and the bobbin thread in cooperation with the fixed blade. A guide member disposed under the lower surface of the movable blade allows the fixed blade to be received between the movable blade and the guide member to guide the needle thread and the bobbin thread arrested by the arresting member to a specified position on the return path of the movable blade. The guide member also holds the needle thread and the bobbin thread at the specified position when the movable blade unit is reciprocated by the driving means. The arresting member, the movable blade and the guide member are arranged one over another and joined to a driving part connected to the driving means.

The guide member may be provided with a guide portion formed by bending a portion thereof upward so as to be in contact with the lower side of the arresting portion of the arresting member. The guide member thus guides the needle thread and the bobbin thread to the fixed blade so that the needle thread and the bobbin thread can be cut with the cooperative action of the movable blade and the fixed blade.

When cutting the threads by this automatic thread cutting device, the movable blade unit connected to the driving means by the driving part is therefore advanced and retracted by the driving means. When the movable blade unit is advanced, the guide member guides the needle thread and the bobbin thread allowing the movable blade unit to arrest the needle thread and the bobbin thread. When the movable blade unit is retracted, the needle thread and the bobbin thread are guided by the guide member and arrested by the arresting portion of the arresting member. Then, the guide member guides the needle thread and the bobbin thread to a specified position on the return path of the movable blade and holds the needle thread and the bobbin thread at the specified position. Thus, the needle thread and the bobbin thread are caught by the fixed blade disposed under the movable blade. Then, the needle thread and the bobbin thread are cut simultaneously by the shearing action of the movable blade and the fixed blade.

The upwardly bent guide portion of the guide member is in contact with the lower side of the arresting portion of the arresting member. By this arrangement, the needle thread and the bobbin thread are surely guided to and held at the specified position by the guide portion.

This movable blade unit comprises the arresting member for arresting the needle thread and the bobbin thread, the movable blade for cutting the needle thread and the bobbin thread in cooperation with the fixed blade, and the guide member for guiding the needle thread and the bobbin thread arrested by the arresting member to the specified position and holding the same at the specified position. Thus, the arresting member, movable blade and the guide member are each assigned a single function. Accordingly, the arresting member, the movable blade and the guide member are simple in shape, and the movable blade unit has a simple construction. Hence, the automatic thread cutting device can be manufactured at a reduced cost.

BRIEF DESCRIPTION OF THE DRAWINGS

A preferred embodiment of the present invention is described in detail with reference to the following drawings, wherein.

DETAILED DESCRIPTION OF PREFERRED EMBODIMENTS

An automatic thread cutting device embodying the present invention is described hereinafter with reference to the accompanying drawings as applied to an electronically controlled zigzag sewing machine, which will be referred to simply as "sewing machine."

The sewing machine M is similar in construction to a conventional electronically controlled zigzag sewing machine and is only briefly described.

Figure 1:
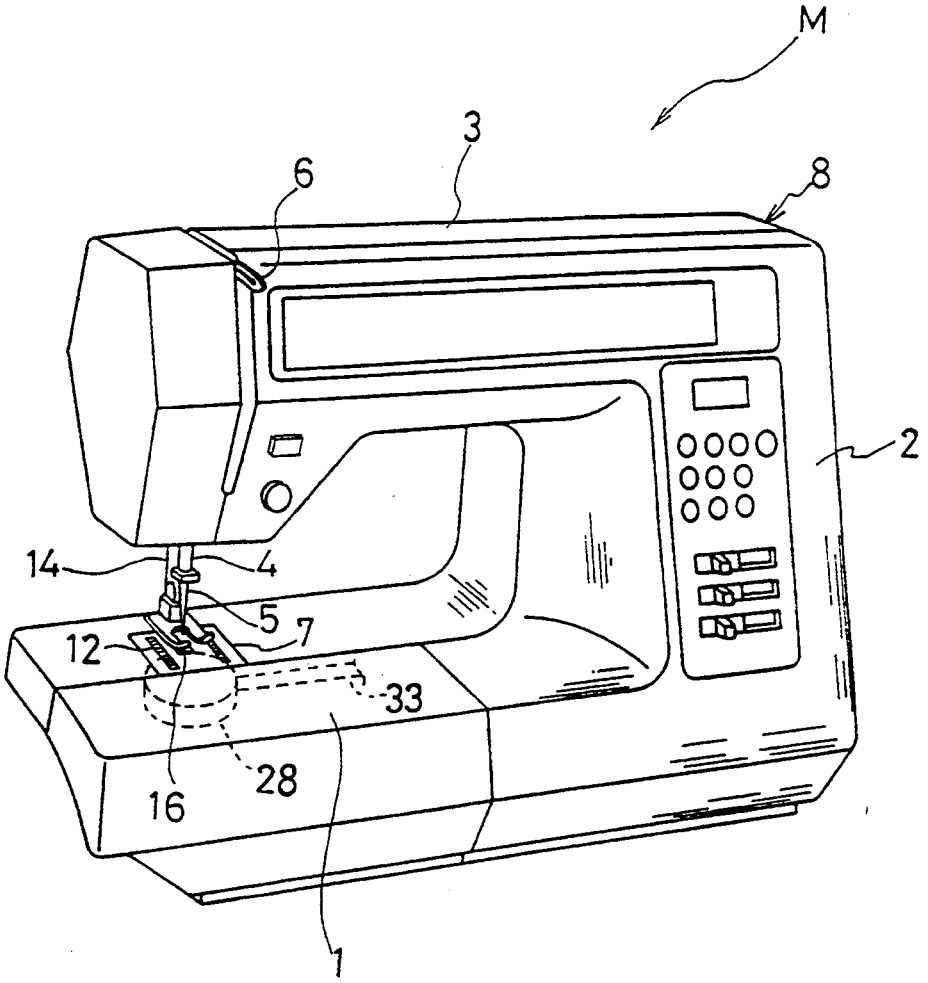
FIG. 1 is a schematic perspective view of an electronically controlled zigzag sewing machine.
Figure 2:
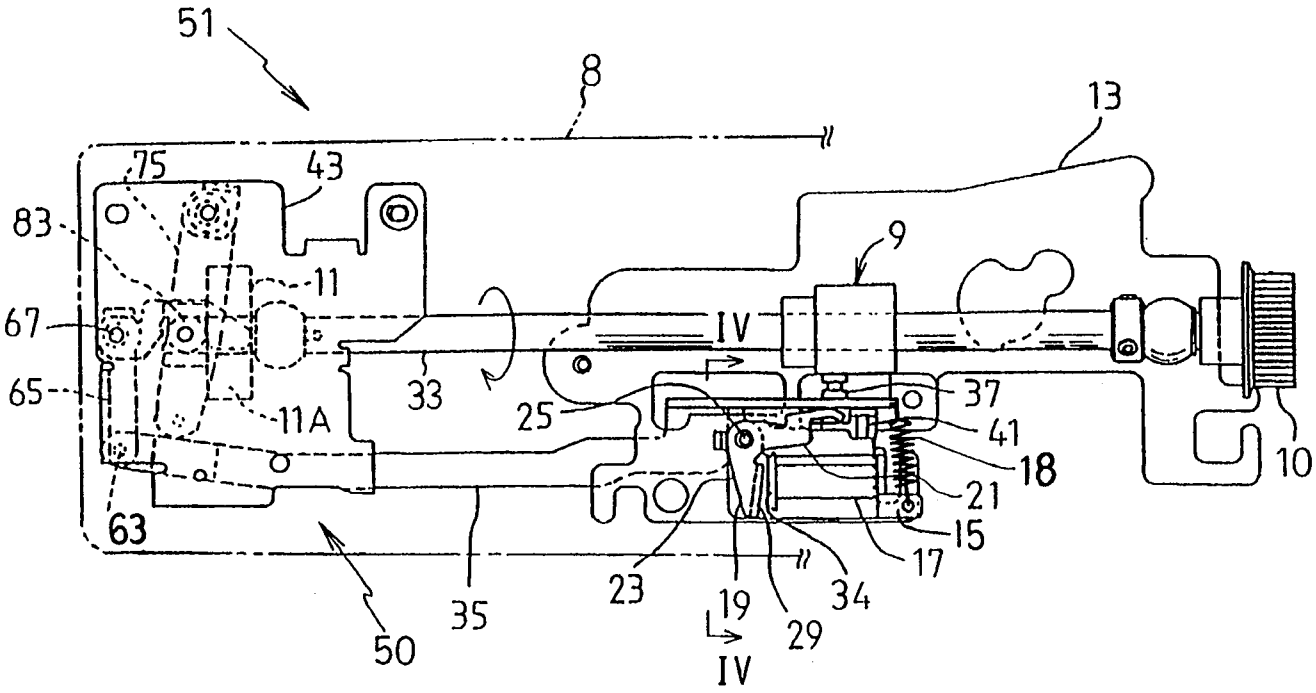
FIG. 2 is a plan view of a principal portion of the bed unit of the electronically controlled zigzag sewing machine of FIG. 1.

Referring to FIG. 1, the sewing machine M has a bed unit 1, a pedestal unit 2 standing upright from the right end of the bed unit 1, and an arm unit 3 extending to the left from the upper end of the pedestal unit (column) 2 over the bed unit 1. As shown in FIG. 2, the bed unit 1 comprises a thread cutting device 51, a vertical feed mechanism, not shown, for vertically moving a feed dog 12, a horizontal feed mechanism, not shown, for horizontally moving the feed dog 12, and a horizontal hook assembly 28. The thread cutting device 51 is disposed within the bed unit 1 to cut the needle thread and the bobbin thread. The arm unit 3 comprises a needle bar driving mechanism for vertically reciprocating a needle bar 4 capable of holding a needle 5 on its lower end, a needle bar swinging mechanism for swinging the needle bar 4 across the feed direction, and a thread take-up lever driving mechanism, not shown, for vertically moving a thread take-up lever 6 in synchronism with the vertical motion of the needle bar 4.

The vertical feed mechanism, the needle bar driving mechanism and the thread take-up lever driving mechanism are driven by a main motor. The horizontal feed mechanism is driven by a feed dog driving motor, and the needle bar swinging mechanism is driven by a needle bar driving motor. A presser bar 14 is supported vertically movably on a rear frame 8 behind the needle bar 4, and a presser foot 16 is attached to the lower end of the presser bar 14 so that the needle 5 extends vertically through a space formed in the presser foot 16.

A throat plate 7 is coupled to the upper surface of the bed unit 1 of the sewing machine M. A hook base, not shown, is disposed under the throat plate 7 and attached to a portion of the rear frame 8 in the bed unit 1. The horizontal hook assembly 28 is mounted on the hook base for rotation in a horizontal plane parallel to the throat plate 7.

Figure 12:
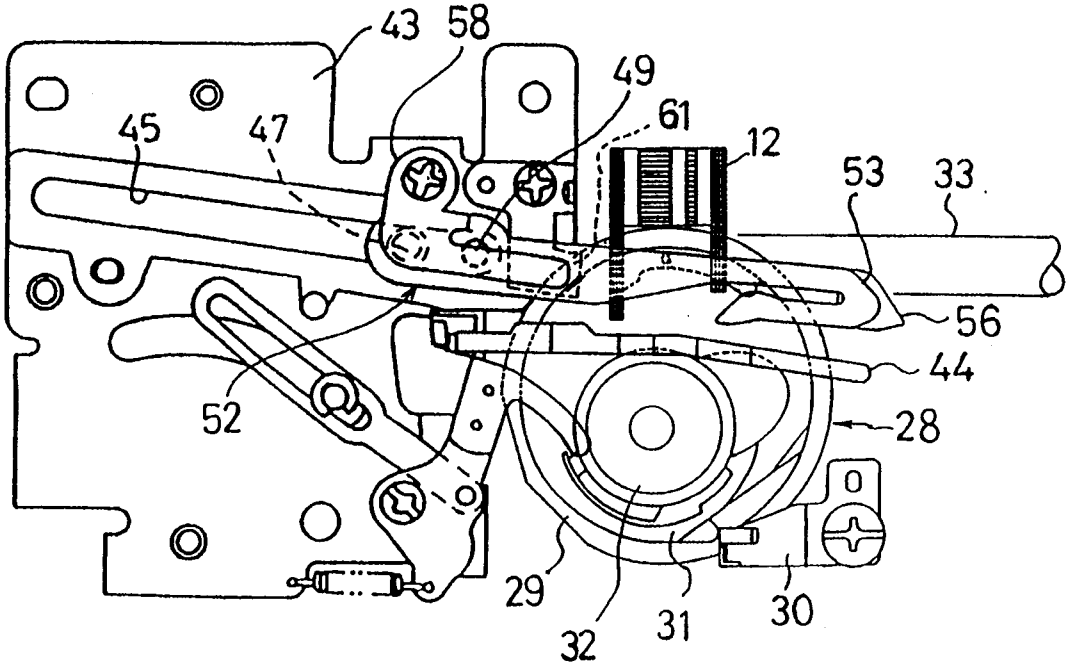
FIG. 12 is a plan view, corresponding to FIG. 6, of a portion of the bed unit including a horizontally rotating shuttle.

As seen in FIG. 12, the horizontal hook assembly 28 comprises a rotating hook 29 that rotates in a horizontal plane about a vertical axis, a rotating hook bobbin case 31 disposed in the rotating hook 29, and a hook holder 30 stationarily holding the rotating hook bobbin case 31 in the rotating hook 29. A bobbin 32 is supported rotatably in the rotating hook bobbin case 31. A rotating hook shaft 33 extends laterally through the hook base within the bed unit 1 and is supported for rotation. The rotating hook shaft 33 and the rotating hook 29 are interlocked by a gear mechanism, not shown, and transmit the motion of the rotating hook shaft 33 to the horizontal hook assembly 28.

Figure 6:
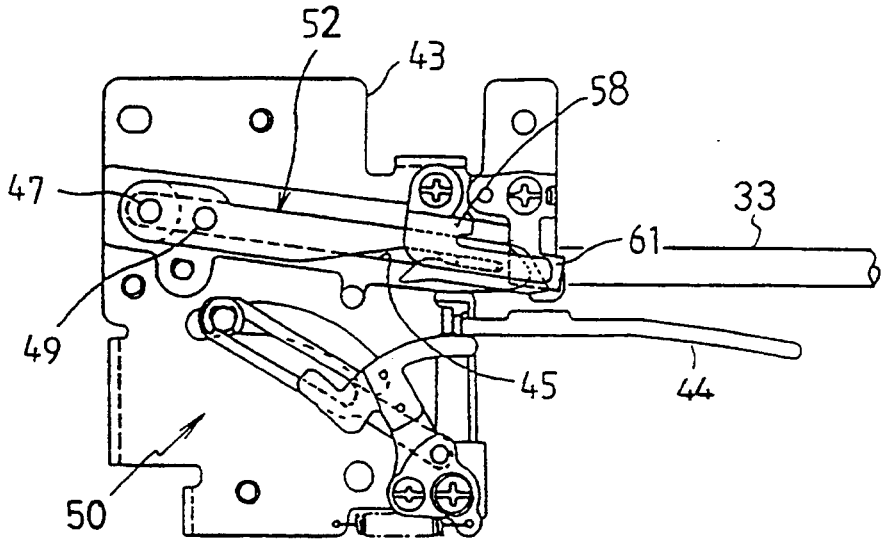
FIG. 6 is a top plan view of a principal portion of the bed unit.

Referring to FIGS. 2 and 6, driving mechanism 50 reciprocates a movable blade unit 52, which is described below. As seen in FIG. 2, a timing belt pulley 10 is fixed to the right end of the rotating hook shaft 33 and is operatively connected to the main motor by a timing belt, not shown. The rotating hook shaft 33 is driven for rotation via the timing belt and the timing belt pulley 10 by the main motor.

Figure 3:
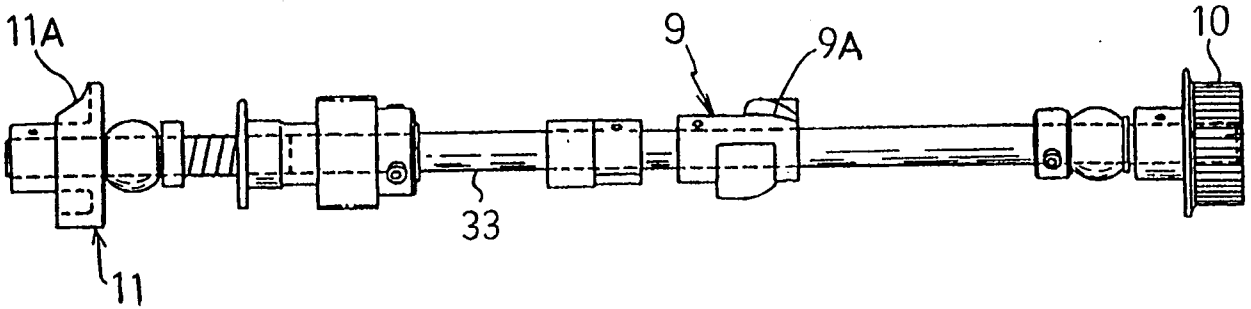
FIG. 3 is an enlarged plan view of the rotating hook shaft of the electronically controlled zigzag sewing machine of FIG. 1.

As shown in FIGS. 2 and 3, a thread cutting cam 9 is fixed to the rotating hook shaft 33. A circumferential cam 9A formed on the thread cutting cam 9 operates an operating lever 35. The circumferential cam 9A has a first cam section, not shown, for shifting the operating lever 35 from its standby position to its working position, a second cam section, not shown, for holding the operating lever 35 at the working position, and a third cam section, not shown, for returning the operating lever 35 to the standby position after a thread cutting operation has been completed.

A thread cutting cam 11 shown in FIG. 3 is fixed to the left end of the rotating hook shaft 33. A circumferential cam 11A is formed on the thread cutting cam 11. A groove is formed in one side surface of the circumferential cam 11A, and a cam follower 83 shown in FIGS. 2 and 7 slides along the groove. The groove of the circumferential cam 11A is formed so as to correspond to the first to third cam sections of the thread cutting cam 9 to carry out a series of steps of the thread cutting operation.

Figure 4:
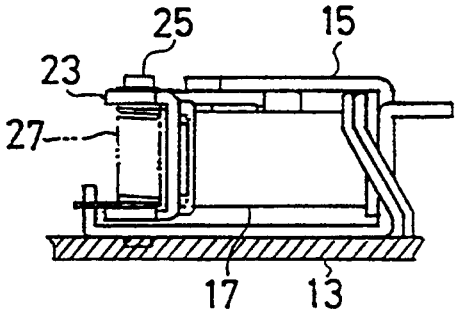
FIG. 4 is a partial sectional view taken on line IV—IV in FIG. 2.

As shown in FIG. 2, a first bracket 13 disposed in a horizontal position under the rotating hook shaft 33 is fixed to the rear frame 8. As shown in FIGS. 2 and 4, a thread cutting electromagnet 17 disposed with its longitudinal axis extending horizontally in parallel to the axis of the rotating hook shaft 33 is fastened to the first bracket 13 with a fastening plate 15.

A swing lever 23 having a shape substantially resembling the letter L is supported pivotally on a pin 25 on the first bracket 13 at a position near the left end of the electromagnet 17. The swing lever 23 has a first arm 19 extending along the core 34 of the thread cutting electromagnet 17 and a second arm 21 extending to the right to a position near the thread cutting cam 9. The swing lever 23 is biased counterclockwise, as viewed in FIG. 2, by a coil spring 27 wound around the pin 25.

Figure 5:
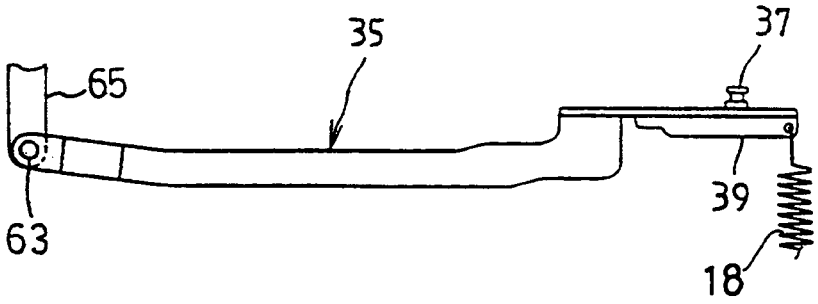
FIG. 5 is an enlarged partial plan view of the operating lever of the electronically controlled zigzag sewing machine of FIG. 1.

As shown in FIGS. 2 and 5, the operating lever 35 extends laterally behind the swing lever 23. The extremity of the second arm 21 of the swing member 23 is in contact with the right end of the operating lever 35. A guide 39 is formed on the right end of the operating lever 35. The guide 39 is associated with a guide member 41. An operating pin 37 is fixed to the guide 39 so as to project backward. The left end of the operating lever 35 is connected to the front end of a clutch lever 65 by a connecting pin 63. An extension spring 18 is extended between the right end of the guide 39 of the operating lever 35 and the fastening plate 15. The extension spring 18 is stiffer than the coil spring 27. Accordingly, the operating lever 35 is biased clockwise, as viewed in FIG. 2, on the connecting pin 63 by the extension spring 18 while the thread cutting operation is not in process, so that the swing lever 23 is held at a position where the first arm 19 is separated from the core 34 by a predetermined distance.

Figure 7:
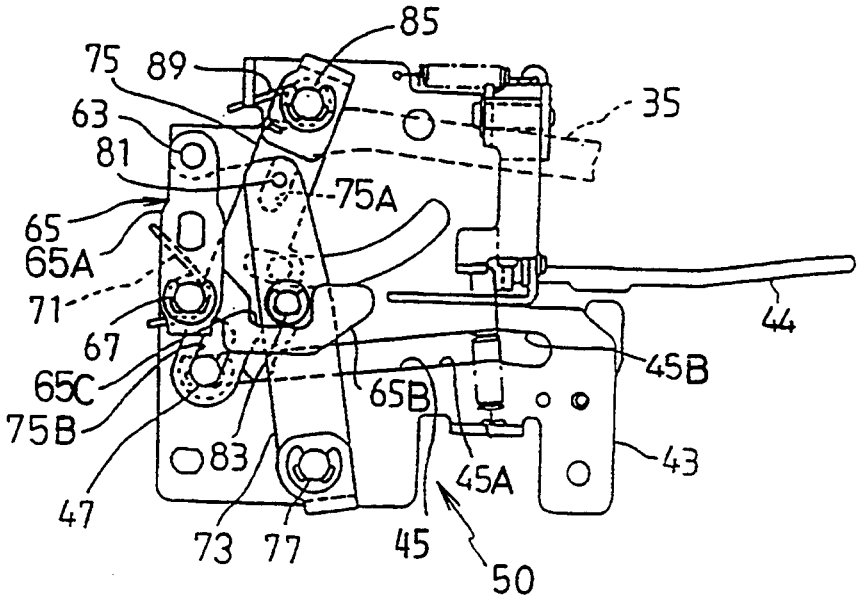
FIG. 7 is a bottom plan view of a principal portion of the bed unit.

Referring to FIGS. 2 and 6, a second bracket 43 is disposed in a horizontal position under the rotating hook shaft 33. A thread guide member 44 is supported pivotally on the second bracket 43 extending laterally along the upper surface of the horizontal hook assembly 28 and crossing the respective paths of the needle thread and the bobbin thread between the throat plate 7 and the horizontal hook assembly 28. As shown in FIG. 7, the second bracket 43 is provided with a lateral guide slot 45 having a first straight section 45A extending substantially in parallel to the guide member 44 and a second straight section 45B extending at a predetermined angle to the first straight section 45A from the right end of the first straight section 45A. The movable blade unit 52 disposed immediately above the guide slot 45 is guided by the guide slot 45 for lateral reciprocation. As shown in FIG. 6, the movable blade unit 52 is restrained from upward movement by a holding member 58 attached to the second bracket 43.

The movable blade unit 52 is described in detail with reference to FIGS. 8 and 9. The movable blade unit 52 comprises an arresting member 53, a movable blade 54, a spacer 55 and a guide member 56.

The arresting member 53 having a strip shape has an arresting portion 53A on its free end for arresting the needle thread and the bobbin thread and a slit 53B for guiding the arrested needle and bobbin threads.

The movable blade 54 having a strip shape is disposed under the arresting member 53. A cutting edge 54A that cuts the needle thread and the bobbin thread in cooperation with a fixed blade 61 is formed in the free end of the movable blade 54, which is an outwardly extending flange generally aligned with the hook shaped arresting portion 53A of the arresting member 53. The arresting member 53 and the movable blade 54 are preferably about 0.5 mm in thickness.

The spacer 55 having a plate shape smaller than the movable blade 54 and the guide member 56 is placed under the movable blade 54 to form a gap for receiving the fixed blade 61 between the movable blade 54 and the guide member 56.

The guide member 56, i.e., the bottom member of the movable blade unit 52, having a strip shape, is placed under the spacer 55 with the fixed blade 61 interposed between the movable blade 54 and the guide member 56. The guide member 56 has a guide portion 56A on its free end and a thread drawing portion 56B. The guide portion 56A extends obliquely upward contacting with the lower side of the arresting portion 53A of the arresting member 53. Preferably, the arresting portion 53A is bonded to guide portion 56A by spot welding, adhesive, brazing or the like. The needle and bobbin threads arrested by the arresting portion 53A of the arresting member 53 slide into the slit 53B, and then the guide portion 56A guides the needle thread and the bobbin thread to the thread drawing portion 56B. In this state, the needle thread and the bobbin thread are in touch with the fixed blade 61. When the movable blade unit 52 is moved, the needle thread and the bobbin thread are cut by the cooperative action of the fixed blade 61 and the movable blade 54. The guide member 56 is preferably about 1.0 mm in thickness.

Figure 8:
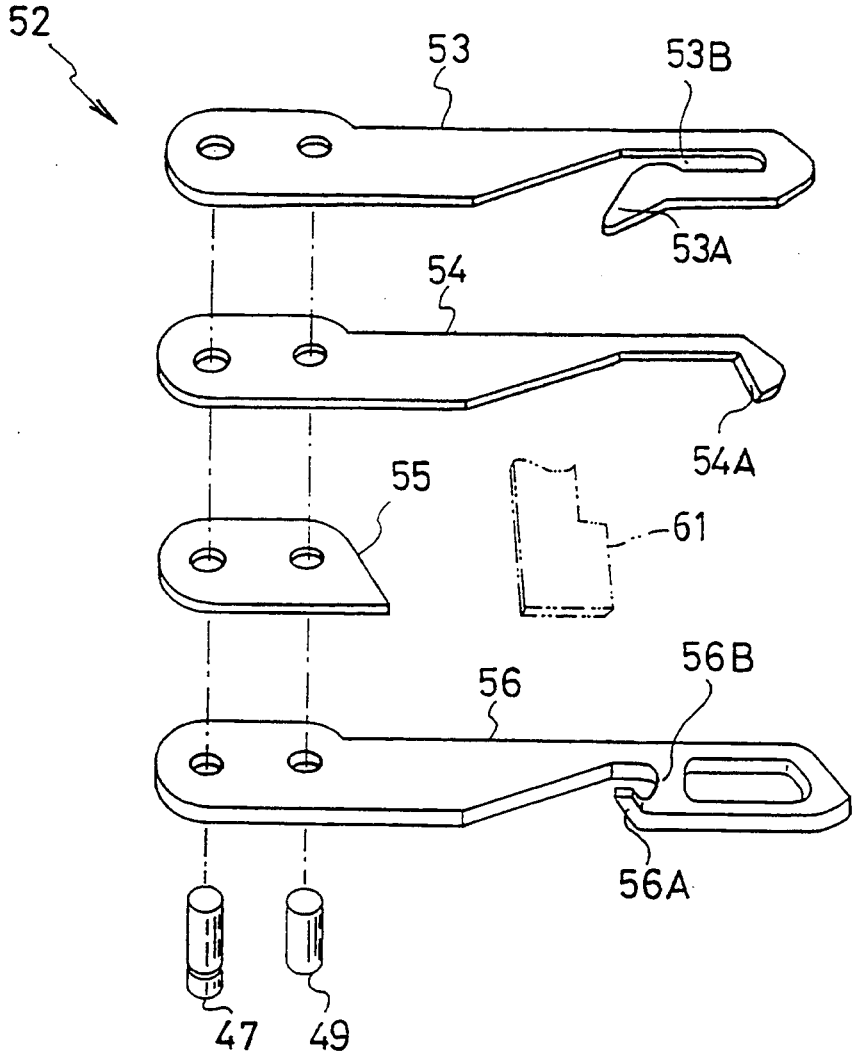
FIG. 8 is an exploded perspective view of a movable blade unit.
Figure 9:
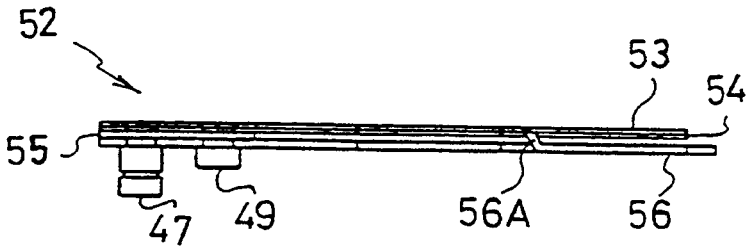
FIG. 9 is a front view of the movable blade unit of FIG. 8.

As shown in FIG. 8, the arresting member 53, the movable blade 54, the spacer 55 and the guide member 56 are superposed in that order and joined with two pins 47 and 49. The pins 47 and 49 couple the movable blade unit 52 to a driven member driven by the driving mechanism 51. The thread drawing portion 56B corresponds to a predetermined position on the return path of the movable blade 54.

As shown in FIGS. 6 and 8, the fixed blade 61, which cooperates with the movable blade 54 to cut the needle thread and the bobbin thread, is fixed to the second bracket 43 positioned between the movable blade 54 and the guide member 56.

As shown in FIG. 7, the substantially L-shaped clutch lever 65 is supported pivotally by a pin 67 on the lower surface of the second bracket 43. The clutch lever 65 has a connecting arm 65A and an interlocking arm 65B offset relative to the connecting arm 65A. The connecting arm 65A is connected at its front end to the left end of the operating lever 35 with a connecting pin 63. The interlocking arm 65B is provided with a recess 65C. A cam follower 83 engages the bottom surface of the recess 65C. A torsion coil spring 71 is wound around the pin 67 biasing the clutch lever 65 resiliently in a counterclockwise direction, as viewed in FIG. 7, to keep the recess 65C in engagement with the cam follower 83.

An intermediate lever 73 and a biasing lever 75 are disposed immediately above the interlocking arm 65B and extend substantially vertically, as viewed in FIG. 7. The intermediate lever 73 is supported pivotally at its rear end by a pin 77 on the second bracket 43. The biasing lever 75 is supported pivotally at its front end by a pin 85 on the second bracket 43. A pin 81 attached to the front end of the intermediate lever 73 is fitted slidably in a slot 75A formed in the biasing lever 75. The cam follower 83 is supported for rotation on the intermediate lever 73 substantially at the middle between its opposite ends. The cam follower 83 engages the left surface of the circumferential cam 11A. The pin 47 of the movable blade unit 52 slidably fits in a slot 75B formed in the rear end of the biasing lever 75. A torsion coil spring 89 is wound around the pin 85 to bias the biasing lever 75 resiliently in a counterclockwise direction, as viewed in FIG. 7.

Figure 11:
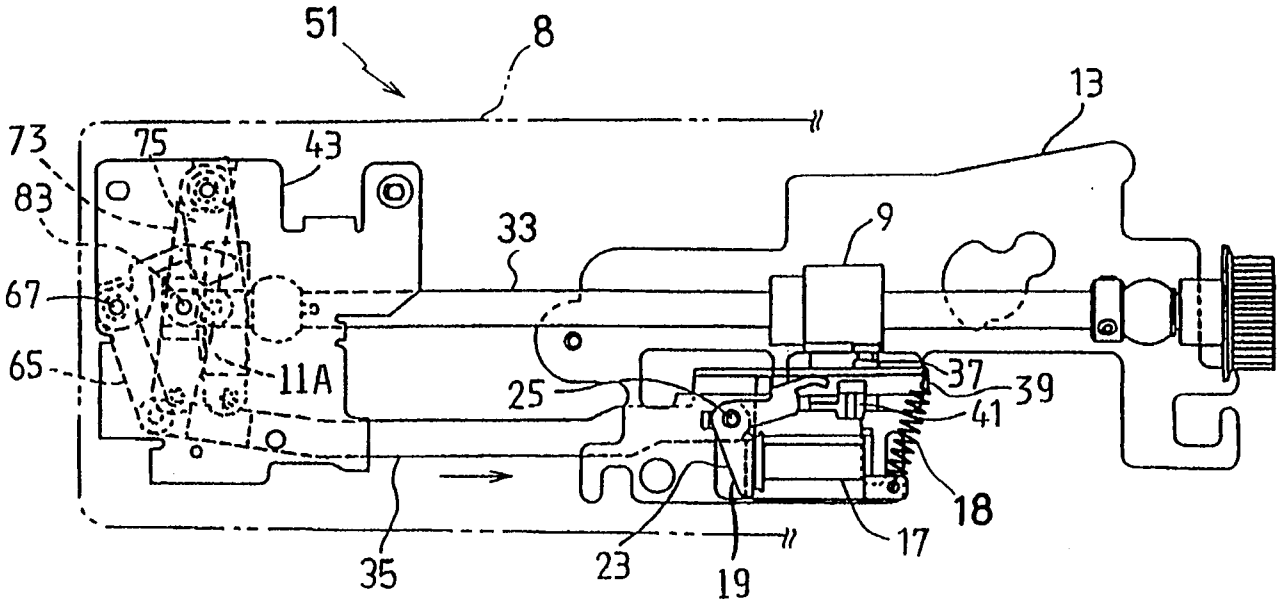
FIG. 11 is a plan view, corresponding to FIG. 2, of the bed unit in a state during the thread cutting operation.

When the operating lever 35 is shifted to the right for the thread cutting operation, the clutch lever 65 turns counterclockwise and, consequently, the cam follower 83 and the recess 65C disengages. Then, as shown in FIGS. 11 and 12, the intermediate lever 73 and the biasing lever 75 turn as the cam follower 83 moves to the right along the circumferential cam 11A. Then, the movable blade unit 52 advances, namely, moves to the right, with its pins 47 and 49 being guided by the guide slot 45 for thread cutting action.

Figure 10:
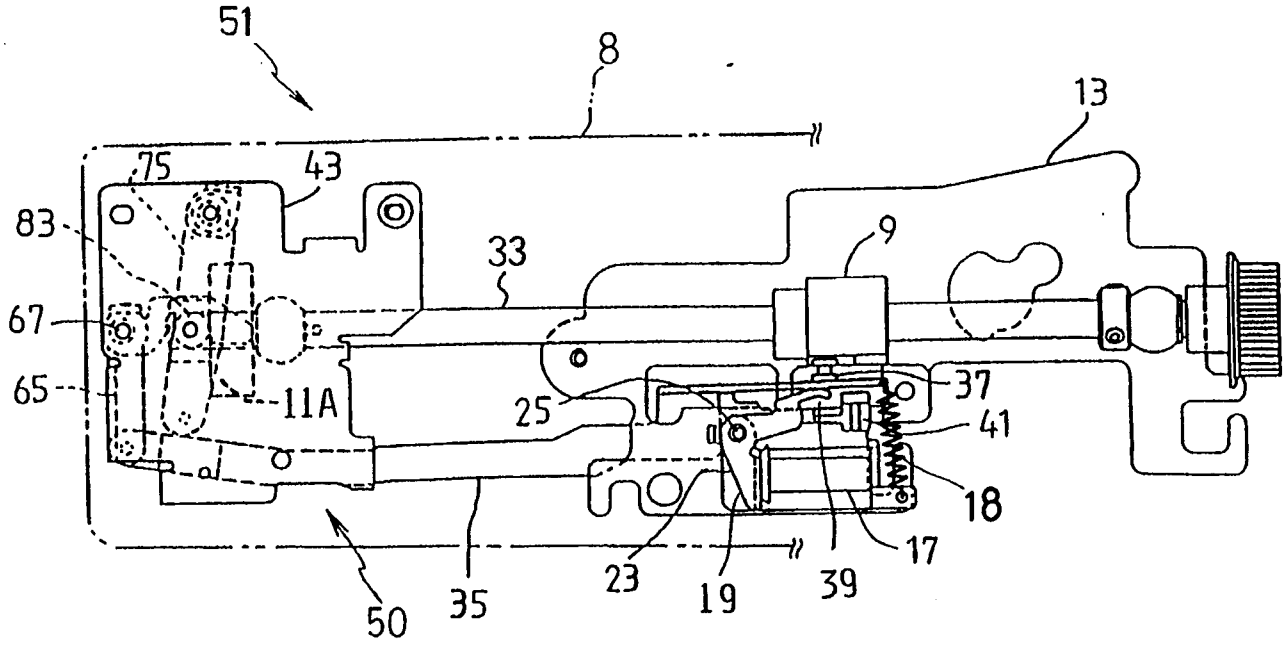
FIG. 10 is a plan view, corresponding to FIG. 2, of the bed unit in a state at the beginning of a thread cutting operation.

The operation of the thread cutting device 51 is described hereinafter. When a thread cutting signal is given, the thread cutting electromagnet 17 is excited at a predetermined time. Then, as shown in FIG. 10, the thread cutting electromagnet 17 attracts the first arm 19 of the swing lever 23 to turn the swing lever 23 counterclockwise against the resilient force of the extension spring 18. Then, the guide portion 39 moves horizontally backward, namely, upward as viewed in FIG. 10, along the guide member 41. Consequently, the operating pin 37 is brought into and held in sliding contact with the circumferential cam 9A of the thread cutting cam 9. As the rotating hook shaft 33 rotates, the operating pin 37 moves to the right following the first cam section, whereby the operating lever 35 is shifted to the right as shown in FIG. 11. Consequently, as mentioned previously, the clutch lever 65 is turned counterclockwise to disengage the cam follower 83 and the recess 65C. The intermediate lever 73 and the biasing lever 75 are turned as the cam follower 83 moves to the right along the groove of the circumferential cam 11A. Consequently, as shown in FIG. 12, the movable blade unit 52 is advanced to a thread arresting position. In this state, the thread guide member 44 moves backward, i.e. moves vertically upward as viewed in FIG. 12, to guide the needle thread and the bobbin thread to a position where the arresting portion 53A of the arresting member 53 is able to arrest the needle thread and the bobbin thread.

Then, as the thread cutting cam 11 rotates, the cam follower 83 is shifted to the left by the groove of the circumferential cam 11A to shift the movable blade unit 52 to the left for return movement. As the movable blade unit 52 moves to the left, the arresting portion 53A arrests the needle thread and the bobbin thread, and then the needle thread and the bobbin thread are guided into the slit 53B and the thread drawing portion 56B by the guide portion 56A so that the needle thread and the bobbin thread are held firmly on the thread drawing portion 56B. As the movable blade unit 52 moves further to the left, the needle thread and the bobbin thread held on the thread drawing portion 56B engage the fixed blade 61. Then, the needle thread and the bobbin thread are cut simultaneously by the cooperative action of the movable blade 54 and the fixed blade 61.

When the cam follower 83 is moved by the circumferential cam 11A to the left to a position where the cam follower 83 coincides with the recess 65C, the operating pin 37 is moved to the left together with the operating lever 35 by the circumferential cam 9A. Thus, the clutch lever 65 is turned to its interlocking position and, consequently, the cam follower 83 and the recess 65C are engaged. Then, the excitation of the thread cutting electromagnet 17 is stopped and the swing lever 23 is turned to its initial position by the resilient force of the extension spring 18. When a series of steps of the thread cutting operation is thus completed, the main motor is stopped.

As mentioned above, the movable blade unit 52 includes the arresting member 53 for arresting the needle thread and the bobbin thread, the movable blade 54 for cutting the needle thread and the bobbin thread in cooperation with the fixed blade 61, and the guide member 56 for guiding and holding the arrested needle and bobbin threads to the thread drawing portion **56*b* lying in the return path of the movable blade 54. The arresting member 53, the movable blade 54 and the guide member 56 are each assigned a single function. Accordingly, the arresting member 53, the movable blade 54 and the guide member 56 are simple in shape. Hence, the movable blade unit 52 has a simple construction and can be manufactured at a reduced manufacturing cost. The guide portion 56A of the guide member 56 ensures that the needle thread and the bobbin thread are drawn out, guiding the same to the thread drawing portion 56B and holding the same at the thread drawing portion 56B**.

The present invention is not limited in its application to the preferred embodiment specifically described herein. Various changes and variations are possible without departing from the scope of this invention.

For example, the materials, shapes and thickness of the arresting member 53, the movable blade 54 and the guide member 56 of the movable blade unit 52 may be changed and varied.

Although the present invention has been described as applied to the thread cutting device of the electronically controlled sewing machine, the present invention is applicable to automatic thread cutting devices for various sewing machines including industrial sewing machines.

Naturally, the present invention is applicable to any apparatus capable of being provided with a thread cutting device including a movable blade unit.

What is claimed is:

1. An automatic thread cutting device to simultaneously cut needle thread and bobbin thread in a sewing machine upon termination of a sewing operation, the sewing machine having a frame, comprising:

a fixed blade coupled to the frame;

a movable blade unit having an arresting member that arrests the needle thread and the bobbin thread, a movable blade disposed adjacent the arresting member that cuts the needle thread and the bobbin thread in cooperation with the fixed blade, and a guide member disposed adjacent and spaced from the movable blade that guides the needle thread and the bobbin thread toward the arresting member to arrest the needle thread and the bobbin thread and holds the needle and bobbin thread to be cut by the movable blade, wherein the arresting member and the guide member are separate member spaced from each other and the fixed blade is received between the movable blade and the guide member; and a driving mechanism coupled to the frame and the movable blade unit that reciprocates the movable blade unit with respect to the frame.

2. The automatic thread cutting device of claim 1, wherein said movable blade unit is disposed within a bed of the sewing machine.

3. The automatic thread cutting device of claim 1, wherein the arresting member, the movable blade and the guide member are each generally flat elongated strips coupled together in a generally parallel configuration.

4. The automatic thread cutting device of claim 1, wherein the movable blade unit further comprises a spacer disposed between the movable blade and the guide member.

5. The automatic thread cutting device of claim 1, wherein the arresting member has a hook defining a slit, the hook forming an arresting portion for arresting the needle and bobbin threads and the slit guiding the arrested threads.

6. The automatic thread cutting device of claim 5, wherein the movable blade has a flange with a cutting edge, the flange being generally aligned with the hook of the arresting member.

7. The automatic thread cutting device of claim 6, wherein the guide member has a guide portion guiding the arrested threads and a thread drawing portion drawing the arrested threads toward the movable blade, the thread drawing portion being generally aligned with the flange of the movable blade.

8. The automatic thread cutting device of claim 7, wherein the guide member is longer than the movable blade and extends beyond the flange of the movable blade.

9. The automatic thread cutting device of claim 7, wherein the guide portion is un upwardly protruding member contacting the arresting portion of the arresting member.

10. The automatic thread cutting device of claim 7, wherein the thread drawing portion is a transverse member disposed adjacent to the guide portion.

11. The automatic thread cutting device of claim 1, wherein the movable blade has a flange with a cutting edge.

12. The automatic thread cutting device of claim 5, wherein the guide member has a guide portion guiding the arrested threads and contacting the arresting portion of the arresting member and a thread drawing portion drawing the arrested threads toward the movable blade.

13. The automatic thread cutting device of claim 12, wherein the guide portion is bonded to the arresting portion.

14. The automatic thread cutting device of claim 13, wherein the guide portion is bonded to the arresting portion by a method selected from the group consisting of spot welding, adhesively securing and brazing.

15. The automatic thread cutting device of claim 12, wherein the guide portion is un upwardly protruding member contacting the arresting portion of the arresting member.

16. The automatic thread cutting device of claim 14, wherein the thread drawing portion is a transverse member disposed adjacent to the guide portion.

17. A movable blade assembly for cutting threads in conjunction with a fixed blade, comprising:

an arresting member having a hook that arrests the threads to be cut and guides the arrested threads;

a movable blade coupled to the arresting member with a cutting edge disposed adjacent to the hook;

a guide member coupled to the movable blade with the movable blade disposed between the arresting member and the guide member, having an outwardly extending guide portion that guides the arrested threads toward the movable blade.

18. The movable blade of claim 17, wherein the outwardly extending guide portion extends past the movable blade and contacts the arresting member, and wherein the guide member has a thread drawing portion disposed adjacent the movable blade.

19. The movable blade assembly of claim 18, wherein the guide portion is bonded to the arresting member.

20. The movable blade assembly of claim 19, wherein the guide portion is bonded to the arresting member by a method selected from the group consisting of spot welding, adhesively securing and brazing.

21. The movable blade of claim 17, further comprising a spacer coupled between the movable blade and the guide portion for accommodating a fixed blade.

22. The movable blade of claim 17, wherein the arresting member, the movable blade and the guide member are each generally flat strips coupled together in parallel for simultaneous movement.

* * * * *